US005794609A

United States Patent [19]

Grant

[11] Patent Number: 5,794,609

[45] Date of Patent: Aug. 18, 1998

[54] HOT WATER HEATER DRAINAGE SYSTEM

[76] Inventor: Clifford Grant, 44 Gray St., Montclair, N.J. 07042

[21] Appl. No.: 910,527

[22] Filed: Aug. 7, 1997

[51] Int. Cl.[6] ..... F24H 1/00

[52] U.S. Cl. ..... 126/363; 126/350 R; 137/312; 122/504

[58] Field of Search ..... 126/350 R, 363, 126/364, 365, 359, 344; 122/504, 507; 137/312

[56] References Cited

U.S. PATENT DOCUMENTS

| | | | |
|---|---|---|---|
| 1,334,678 | 3/1920 | Riley | 137/312 |
| 4,512,288 | 4/1985 | Michaud | 126/365 |
| 5,085,205 | 2/1992 | Hall et al. | 126/350 R |

*Primary Examiner*—James C. Yeung

[57] ABSTRACT

A water heater overflow prevention system is provided including a water heater with a cylindrical configuration having a circular bottom face, a circular top face, and a tubular periphery formed therebetween defining an interior space. The water heater has an overflow pipe connected to the top face of the water heater and extended downwardly adjacent to the periphery of the water heater. Such overflow pipe terminates with an open end adjacent the bottom face of the water heater for allowing excess water from the water heater to flow therefrom. Further provided is an overflow pan including a circular base with a cylindrical periphery integrally coupled thereto and extending upwardly therefrom thereby defining an open top and an interior space in which the water heater and overflow pipe are situated. An aperture is formed in the periphery of overflow pan adjacent the base thereof. Also included is a drainage pipe having a first end coupled to the aperture of the overflow pan for draining the overflow pan of any excess water that may be present therein. Finally, it is imperative that a height of the pan be greater than ⅓ that of the water heater.

5 Claims, 2 Drawing Sheets

HOT WATER HEATER DRAINAGE SYSTEM

BACKGROUND OF THE INVENTION

1. Field of the Invention

The present invention relates to water heater pans and more particularly pertains to a new HOT WATER HEATER DRAINAGE SYSTEM for allowing the containment and drainage of excess water expelled from a water heater.

2. Description of the Prior Art

The use of water heater pans is known in the prior art. More specifically, water heater pans heretofore devised and utilized are known to consist basically of familiar, expected and obvious structural configurations, notwithstanding the myriad of designs encompassed by the crowded prior art which have been developed for the fulfillment of countless objectives and requirements.

Known prior art water heater pans include U.S. Pat. No. 5,345,224; U.S. Pat. No. 4,085,773; U.S. Pat. No. 5,357,241; U.S. Pat. No. 4,245,748; U.S. Pat. No. 4,987,408; and U.S. Pat. No. 4,944,253.

In these respects, the HOT WATER HEATER DRAINAGE SYSTEM according to the present invention substantially departs from the conventional concepts and designs of the prior art, and in so doing provides an apparatus primarily developed for the purpose of allowing the containment and drainage of excess water expelled from a water heater.

SUMMARY OF THE INVENTION

In view of the foregoing disadvantages inherent in the known types of water heater pans now present in the prior art, the present invention provides a new HOT WATER HEATER DRAINAGE SYSTEM construction wherein the same can be utilized for allowing the containment and drainage of excess water expelled from a water heater.

The general purpose of the present invention, which will be described subsequently in greater detail, is to provide a new HOT WATER HEATER DRAINAGE SYSTEM apparatus and method which has many of the advantages of the water heater pans mentioned heretofore and many novel features that result in a new HOT WATER HEATER DRAINAGE SYSTEM which is not anticipated, rendered obvious, suggested, or even implied by any of the prior art water heater pans, either alone or in any combination thereof.

To attain this, the present invention generally comprises a water heater with a cylindrical configuration having a circular bottom face, a circular top face, and a tubular periphery formed therebetween defining an interior space. As shown in FIG. 2, the bottom face has a plurality of feet for elevating the water heater above ground. The water heater also includes a water input line connected to the top face thereof for receiving water to be heated and a water output line connected to the top face thereof for delivering water that has been heated. Note FIG. 1. Further provided is an overflow pipe connected to the top face of the water heater and extended downwardly adjacent to and in parallel with the periphery of the water heater. The overflow pipe terminates at a open end adjacent the bottom face of the water heater for allowing excess water from the water heater to flow therefrom. Further included is an exhaust pipe having a vertical extent connected to the top face of the water heater and a horizontal extent in communication with the vertical extent and extended outwardly therefrom. In use, the exhaust pipe is adapted for allowing the expelling of harmful gases from the water heater. As shown in FIG. 2, the water heater further has a control panel situated on the periphery adjacent the bottom face thereof. The control panel is adapted to allow the selective actuation of the water heater and further the determination of an amount of heated water available therein. Also included is an overflow pan having a circular base with a cylindrical periphery integrally coupled thereto and extending upwardly therefrom. As such, an open top and an interior space is defined in which the water heater is situated. It should be noted that the overflow tube is also situated within the pan. The overflow pan further has an upper peripheral lip integrally coupled to the periphery of the overflow pan and extended upwardly and radially outwardly therefrom. A threaded aperture is formed in the periphery of overflow pan adjacent the base thereof. A square cutout is formed in the periphery of the overflow pan for allowing access to the control panel. An access cover is adapted to be removably secured over the square cutout for precluding the leaking of water therefrom. It is imperative that a height of the pan be greater than ⅓ that of the water heater. Also included is a horizontally oriented drainage pipe having a first end threadedly coupled to the threaded aperture of the overflow pan. A second end of the drainage pipe resides in communication with a sewer for draining the overflow pan of any excess water that may be present therein. Finally, a vertical vent pipe is provided having a first end in communication with the drainage pipe and a second end connected to the exhaust pipe. The vent pipe is adapted for allowing the escape of harmful gases from the sewer to the exhaust pipe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new HOT WATER HEATER DRAINAGE SYSTEM apparatus and method which has many of the advantages of the water heater pans mentioned heretofore and many novel features that result in a new HOT WATER HEATER DRAINAGE SYSTEM which is not anticipated, rendered obvious, suggested, or even implied by any of the prior art water heater pans, either alone or in any combination thereof.

It is another object of the present invention to provide a new HOT WATER HEATER DRAINAGE SYSTEM which may be easily and efficiently manufactured and marketed.

It is a further object of the present invention to provide a new HOT WATER HEATER DRAINAGE SYSTEM which is of a durable and reliable construction.

An even further object of the present invention is to provide a new HOT WATER HEATER DRAINAGE SYSTEM which is susceptible of a low cost of manufacture with regard to both materials and labor, and which accordingly is then susceptible of low prices of sale to the consuming public, thereby making such HOT WATER HEATER DRAINAGE SYSTEM economically available to the buying public.

Still yet another object of the present invention is to provide a new HOT WATER HEATER DRAINAGE SYSTEM which provides in the apparatuses and methods of the prior art some of the advantages thereof, while simultaneously overcoming some of the disadvantages normally associated therewith.

Still another object of the present invention is to provide a new HOT WATER HEATER DRAINAGE SYSTEM for allowing the containment and drainage of excess water expelled from a water heater.

Even still another object of the present invention is to provide a new HOT WATER HEATER DRAINAGE SYSTEM that includes a water heater with a cylindrical configuration having a circular bottom face, a circular top face, and a tubular periphery formed therebetween defining an interior space. The water heater has an overflow pipe connected to the top face of the water heater and extended downwardly adjacent to the periphery of the water heater.

Such overflow pipe terminates with an open end adjacent the bottom face of the water heater for allowing excess water from the water heater to flow therefrom. Further provided is an overflow pan including a circular base with a cylindrical periphery integrally coupled thereto and extending upwardly therefrom thereby defining an open top and an interior space in which the water heater and overflow pipe are situated. An aperture is formed in the periphery of overflow pan adjacent the base thereof. Also included is a drainage pipe having a first end coupled to the aperture of the overflow pan for draining the overflow pan of any excess water that may be present therein. Finally, it is imperative that a height of the pan be greater than ⅓ that of the water heater.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
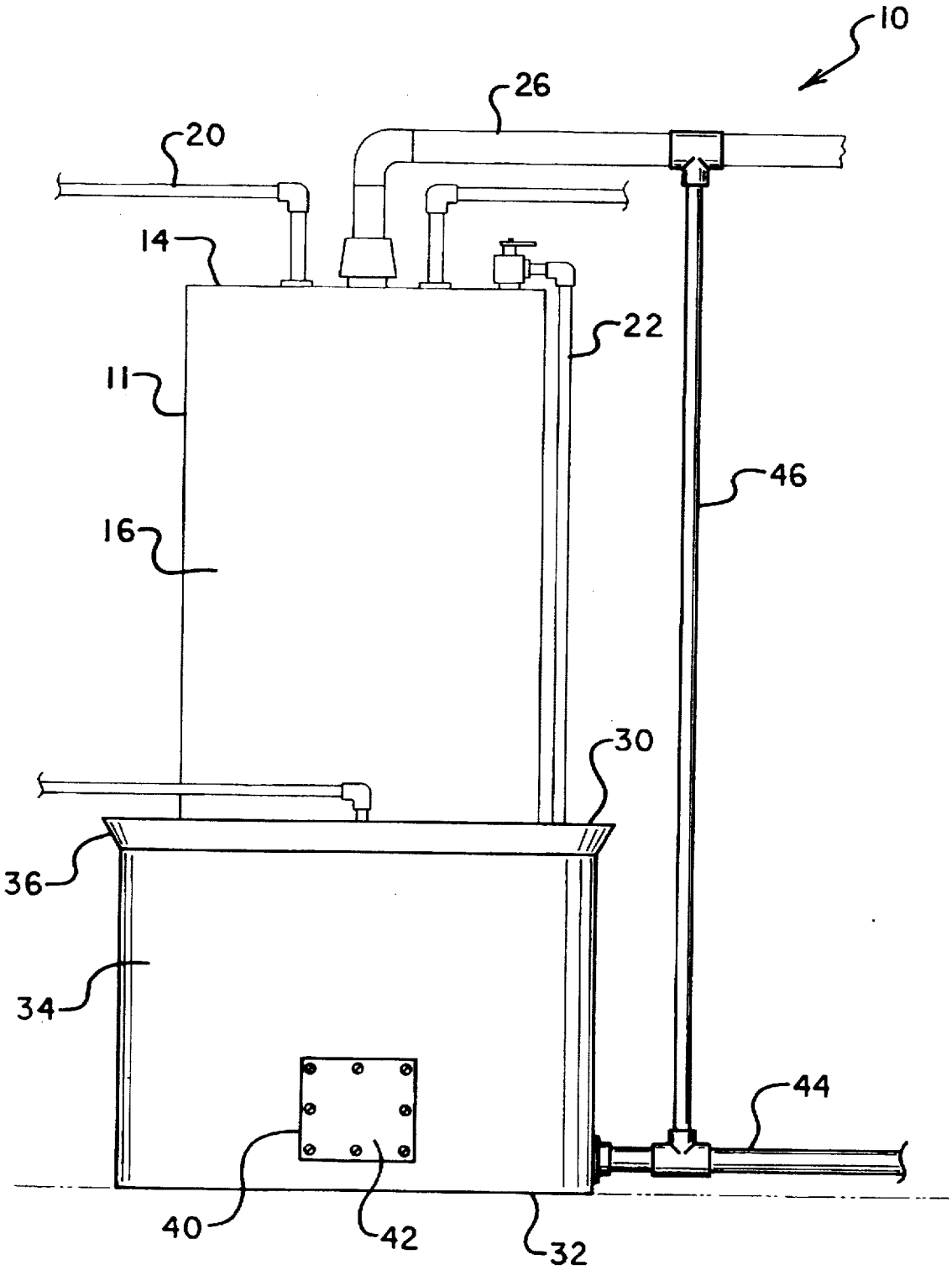
FIG. 1 is a front view of a new HOT WATER HEATER DRAINAGE SYSTEM according to the present invention.

With reference now to the drawings, a new HOT WATER HEATER DRAINAGE SYSTEM embodying the principles and concepts of the present invention and generally designated by the reference numeral 10 will be described.

Figure 2:
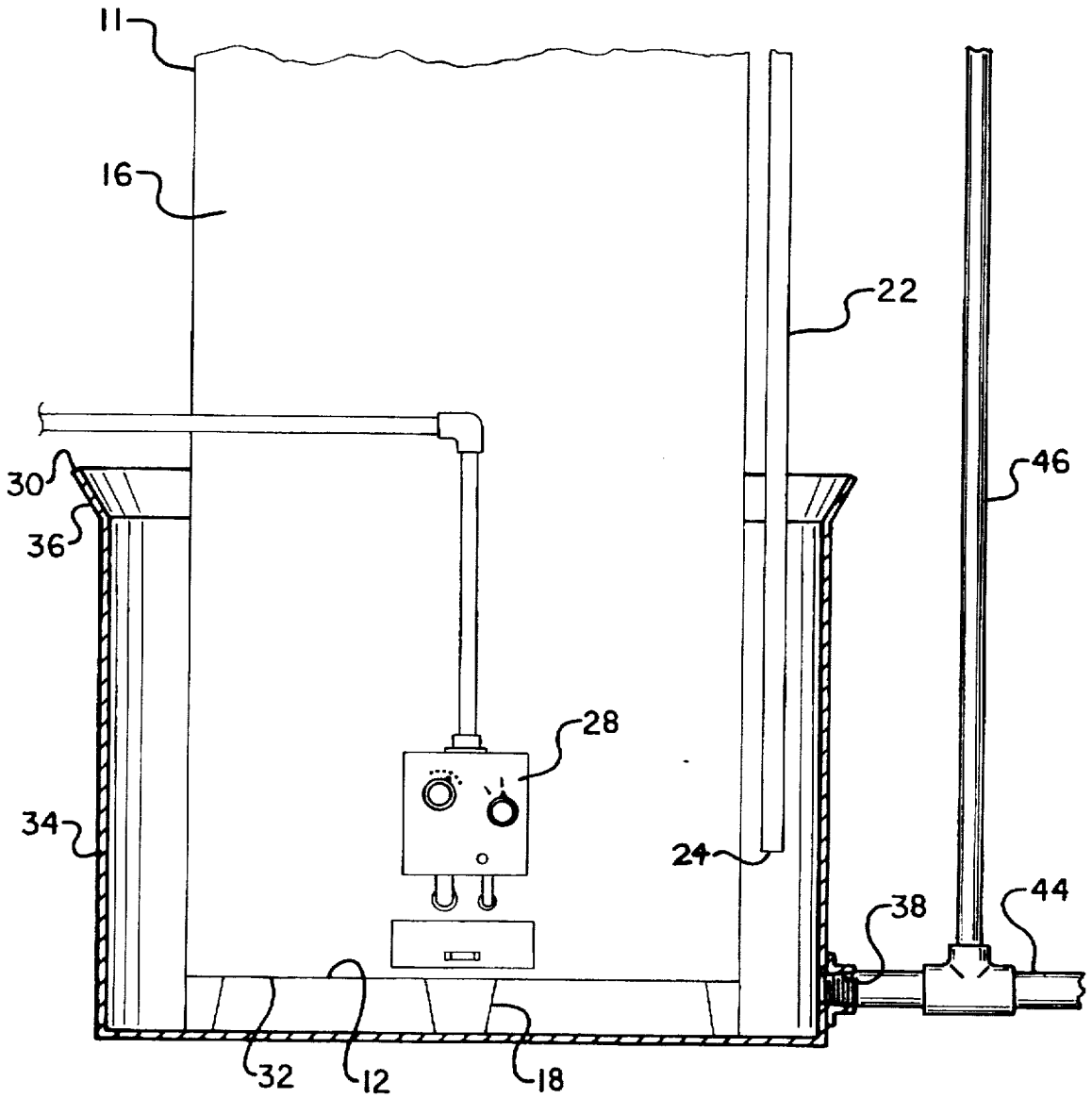
FIG. 2 is a cross-sectional view of the present invention.

As shown in the Figures, the system 10 of the present invention includes a water heater 11 with a cylindrical configuration having a circular bottom face 12, a circular top face 14, and a tubular periphery 16 formed therebetween defining an interior space. As shown in FIG. 2, the bottom face has a plurality of feet 18 for elevating the water heater above ground. The water heater also includes a water input line 20 connected to the top face thereof for receiving water to be heated and a water output line connected to the top face thereof for delivering water that has been heated. Note FIG. 1.

Further provided as a component of the water heater is an overflow pipe 22. Such pipe is connected to the top face of the water heater and extended downwardly adjacent to and in parallel with the periphery of the water heater. The overflow pipe terminates at a open end 24 adjacent the bottom face of the water heater for allowing excess water from the water heater to flow therefrom. Further included is an exhaust pipe 26 having a vertical extent connected to the top face of the water heater and a horizontal extent in communication with the vertical extent and extended outwardly therefrom. In use, the exhaust pipe is adapted for allowing the expelling of harmful gases from the water heater. As shown in FIG. 2, the water heater further has a control panel 28 situated on the periphery adjacent the bottom face thereof. The control panel is adapted to allow the selective actuation of the water heater and further the determination of an amount of heated water available therein.

Also included is an overflow pan 30 having a circular base 32 with a cylindrical periphery 34 integrally coupled thereto and extending upwardly therefrom. As such, an open top and an interior space is defined in which the water heater is situated. It should be noted that the overflow tube is situated between the pan and the water heater. The overflow pan further has an upper peripheral lip 36 integrally coupled to the periphery of the overflow pan and extended upwardly and radially outwardly therefrom. A threaded aperture 38 is formed in the periphery of overflow pan in juxtaposition with the base thereof.

For allowing access to the control panel of the water heater, the overflow pan has a square cutout 40 formed in the periphery thereof. An access cover 42 is adapted to be removably secured over the square cutout for precluding the leaking of water therefrom. Preferably, a plurality of screws are employed to secure the cover in place. Further, an unillustrated gasket is utilized in conjunction with the cover to ensure an optimal seal. It is imperative that a height of the pan be greater than ⅓ that of the water heater. As such, when the present invention includes a water heater with a height of about 3 feet, the height of the pan is 12 inches. In the preferred embodiment, the overflow pan has a diameter which exceeds that of the hot water heater by at least 6 inches.

Also included is a horizontally oriented drainage pipe 44 having a first end threadedly coupled to the threaded aperture of the overflow pan. A second end of the drainage pipe resides in communication with a sewer for draining the overflow pan of any excess water that may be present therein.

Finally, a vertical vent pipe 46 is provided having a first end in communication with the drainage pipe and a second end connected to the exhaust pipe. Such interconnection is preferably facilitated by way of a pair of T-shaped interconnects. In use, the vent pipe is adapted for allowing the escape of harmful gases from the sewer to the exhaust pipe.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A water heater overflow prevention device comprising, in combination:

a water heater with a cylindrical configuration, said cylindrical configuration having a circular bottom face, a circular top face, and a tubular periphery formed between said top face and said bottom face;

said top face, bottom face and tubular periphery defining an interior space, wherein the bottom face has a plurality of feet for elevating the water heater above ground, the water heater having a water input line connected to the top face thereof for receiving water to be heated, a water output line connected to the top face thereof for delivering water that has been heated, an overflow pipe connected to the top face of the water heater and extending downwardly adjacent to and in parallel with the periphery of the water heater and terminating at a open end adjacent the bottom face of the water heater for allowing excess water from the water heater to flow therefrom, and an exhaust pipe having a vertical extent connected to the top face of the water heater and a horizontal extent in communication with the vertical extent and extending outwardly therefrom, the exhaust pipe adapted for allowing the expelling of harmful gases from the water heater, the water heater further having a control panel situated on the periphery adjacent the bottom face thereof, the control panel adapted to allow the selective actuation of the water heater and further the determination of an amount of heated water available therein;

an overflow pan including a circular base with a cylindrical periphery integrally coupled thereto and extending upwardly therefrom thereby defining an open top and an interior space in which the water heater is situated such that the overflow tube is also situated within the pan, the overflow pan further having an upper peripheral lip integrally coupled to the periphery of the overflow pan and extended upwardly and radially outwardly therefrom, a threaded aperture formed in the periphery of overflow pan adjacent the base thereof, a square cutout formed in the periphery of the overflow pan for allowing access to the control panel, and an access cover adapted to be removably secured over the square cutout for precluding the leaking of water therefrom, wherein a height of the pan is greater than ⅓ that of the water heater;

a horizontally oriented drainage pipe having a first end threadedly coupled to the threaded aperture of the overflow pan and a second end in communication with a sewer for draining the overflow pan of any excess water that may be present therein; and a vertical vent pipe having a first end in communication with the drainage pipe and a second end connected to the exhaust pipe, the vent pipe adapted for allowing the escape of harmful gases from the sewer to the exhaust pipe.

2. A water heater overflow prevention device comprising:

a fuel-fired water heater with a cylindrical configuration, said cylindrical configuration having a circular bottom face, a circular top face, and a tubular periphery formed between said bottom face and said top face, said water heater being adapted to burn a fuel at a location adjacent the bottom face of said water heater to heat water in said water heater;

said bottom face, said top face and said tubular periphery defining an interior space, the water heater having a water input line for receiving water to be heated, a water output line for delivering water that has been heated, and an overflow pipe connected to the top face of the water heater and extending downwardly adjacent to the periphery of the water heater and terminating at a open end adjacent the bottom face of the water heater for allowing excess water from the water heater to flow therefrom;

an overflow pan including a circular base with a cylindrical periphery integrally coupled thereto and extending upwardly therefrom thereby defining an open top and an interior space in which the water heater is situated such that the overflow tube is also situated within the pan, an aperture formed in the periphery of overflow pan adjacent the base thereof, wherein a height of the pan is greater than ⅓ that of the water heater;

a drainage pipe to a sewer having a first end coupled to the aperture of the overflow pan for draining the overflow pan of any excess water that may be present therein, said drainage pipe being located adjacent the bottom face of the water heater;

an exhaust pipe extending from the top face of said water heater for venting to the exterior of a building exhaust gases generated by combustion of fuel in said water heater; and a vent pipe in a generally vertical orientation said vent pipe having a lower end in communication with the drainage pipe and an upper end connected to the exhaust pipe such that gases in said drainage pipe may flow upwardly through said vent pipe to said exhaust pipe without entering the interior space of said overflow pan for reducing the possibility of gases in said drainage pipe from becoming ignited by said water heater.

3. A water heater overflow prevention device as set forth in claim 2 wherein the water heater further has a control panel situated on the periphery adjacent the bottom face thereof, the control panel adapted to allow the selective actuation of the water heater and further the determination of an amount of heated water available therein, the overflow pan further including a square cutout formed in the periphery thereof for allowing access to the control panel and an access cover adapted to be removably secured over the square cutout for precluding the leaking of water therefrom.

4. A water heater overflow prevention device as set forth in claim 2 wherein the overflow pan further has an upper peripheral lip integrally coupled to the periphery thereof and extended upwardly and radially outwardly therefrom.

5. A water heater overflow prevention device comprising:

a water heater with a cylindrical configuration having a circular bottom face, a circular top face, and a tubular periphery formed between said top face and said bottom face;

said top face, said bottom face and said tubular periphery defining an interior space, the water heater having a water input line for receiving water to be heated, a water output line for delivering water that has been heated, and an overflow pipe connected to the top face of the water heater and extending downwardly adjacent to the periphery of the water heater and terminating at a open end adjacent the bottom face of the water heater for allowing excess water from the water heater to flow therefrom;

an overflow pan including a circular base with a cylindrical periphery integrally coupled thereto and extending upwardly therefrom thereby defining an open top and an interior space in which the water heater is situated such that the overflow tube is also situated within the pan, an aperture formed in the periphery of overflow pan adjacent the base thereof; and a drainage pipe having a first end coupled to the aperture of the overflow pan for draining the overflow pan of any excess water that may be present therein;

wherein the water heater further has a control panel situated on the periphery adjacent the bottom face thereof, the control panel adapted to allow the selective actuation of the water heater and further the determination of an amount of heated water available therein, the overflow pan further including a square cutout formed in the periphery thereof for allowing access to the control panel and an access cover adapted to be removably secured over the square cutout for precluding the leaking of water therefrom;

an exhaust pipe disposed from said water heater, said exhaust pipe being for allowing the expelling of harmful gases from the water heater; and a vent pipe having a first end in communication with the drainage pipe and a second end connected to the exhaust pipe, the vent pipe adapted for allowing the escape of harmful gases from the sewer to the exhaust pipe.

* * * * *